United States Patent [19]

Gatten

[11] Patent Number: 4,671,412

[45] Date of Patent: Jun. 9, 1987

[54] STACKABLE BOTTLE

[76] Inventor: Robert L. Gatten, 3332 Blair Ridgeway St., Columbus, Ind. 47203

[21] Appl. No.: 827,528

[22] Filed: Feb. 10, 1986

Related U.S. Application Data

[63] Continuation-in-part of Ser. No. 803,950, Nov. 6, 1985.

[51] Int. Cl.[4] ..... B65D 21/02

[52] U.S. Cl. ..... 206/504; 206/509; 215/10; 220/23.4

[58] Field of Search ..... 206/504, 505, 507, 508, 206/509, 427; 215/10; D9/390, 410, 411; 220/23.4

[56] References Cited

U.S. PATENT DOCUMENTS

| | | | |
|---|---|---|---|
| 2,641,374 | 6/1953 | Der Yuen | 215/10 |
| 3,369,688 | 2/1968 | Dike | 215/10 |
| 3,391,824 | 7/1968 | Wiseman | 446/125 |
| 3,994,408 | 11/1976 | Belitzky | 215/10 |
| 4,016,995 | 4/1977 | Frazer | 215/10 |
| 4,165,812 | 8/1979 | Jennison | 215/10 |
| 4,235,343 | 11/1980 | Thompson | 215/10 |
| 4,489,839 | 12/1984 | Epperson | 206/509 |
| 4,570,799 | 2/1986 | Mednis | 215/10 |
| 4,573,595 | 3/1986 | Mednis | 206/509 |

FOREIGN PATENT DOCUMENTS

| | | | |
|---|---|---|---|
| 1187181 | 2/1965 | Fed. Rep. of Germany | 215/10 |

*Primary Examiner*—William Price
*Assistant Examiner*—Brenda J. Ehrhardt
*Attorney, Agent, or Firm*—Woodard, Weikart, Emhardt & Naughton

[57] ABSTRACT

A stackable plastic bottle for enabling a pyramidal display of several such bottles includes a generally cylindrical main body portion whose height and diameter will vary depending on the volume to be created internally and a neck portion which has gradually tapering sides and extends upwardly from the main body portion terminating in a generally cylindrical spout and outlet opening. Oppositely disposed in the neck portion is a pair of receiving recesses which are defined along their lower surface by a substantially horizontal shelf and inwardly therefrom by an upwardly extending peripheral wall. Each recess is sized and arranged such that it is capable of receiving part of the main body portion of a corresponding stackable bottle such that by proper spacing of the bottles row after row, they may be arranged in a pyramidal display.

20 Claims, 13 Drawing Figures

STACKABLE BOTTLE

CROSS-REFERENCE TO RELATED APPLICATION

This application is a continuation-in-part of my copending design patent application Ser. No. 803,950 filed Nov. 6, 1985.

BACKGROUND OF THE INVENTION

The present invention relates in general to molded, plastic bottles and containers. More particularly, the present invention relates to plastic bottles for motor oil and similar products which have been sized and shaped so as to be stackable with each other in an offset pyramidal arrangement.

For many years, automobile motor oil has been offered in either one-quart metal cans or one-quart containers made up of a combination of laminated and lined cardboard for the body and metal for the ends. These cans are typically arranged with a generally straight, cylindrical body and substantially flat ends, which were oriented so as to be perpendicular to the body. Not only do these containers pack neatly into a case (12 cans) but their relative height and diameter dimensions result in a somewhat idealized size for compactness of a one-quart volume.

A further opportunity with these cylindrical oil cans is the ability to stack them compactly into outside, columnar racks for display at service stations. It is also possible to stack the cans into a pyramidal configuration for display such as in a service station window. This ability to stack and display the cans of motor oil is widely employed and somewhat of a "traditional" approach in the advertising and promotion of motor oil. A stacked arrangement enhances the visibility of the product to a passing motorist and to service station customers. Since product visibility is an important aspect of marketing, the ability to stack cylindrical oil cans satisfies this aspect while making the motor oil readily available to the service station attendant when required for a customer.

Within the past two years or so, plastic motor oil bottles have begun to replace the long-time standards of the industry, metal and cardboard cans. Although the plastic bottles could probably be produced so as to duplicate the size and shape of the type of cans they are replacing, bottle manufacturers and the oil companies have elected to go to a bottle design wherein a pouring spout is provided with a screw-on, resealable cap. This new design allows an easy way to open and dispense the oil without requiring the well-known, push-in, reusable metal spout. A further benefit is the ability to reclose the bottle if only a portion of the contents are used, thus keeping the balance of the contents clean and uncontaminated.

Similar plastic bottle concepts exist for a wide range of household, automotive, food and industrial products. These bottles or containers vary as to their shape and volume, though they all generally include a body portion and some type of neck or spout through which the contents pass as they are dispensed. In certain instances, the containers are provided with handles and in some cases tamper-evident or child-resistant closures are used. Many products originated in plastic containers, while other products evolved from an earlier packaging approach such as a metal can or glass bottle. Since these products were and are typically displayed on horizontal store shelves, the stacking and display in a manner similar to motor oil was never much of a factor or consideration in the marketing approach followed for these products.

When plastic bottles are used, stacking onto one another, such as with cylindrical cans, is unavailable. Due to the neck and spout configuration on plastic bottles, a substantially flat top surface which is used for the stacking is not provided. As previously mentioned, while such plastic containers might be fabricated in a generally cylindrical configuration, one very beneficial and important aspect is the presence of a tapered neck or spout for easy pouring and dispensing of the contents. Since the spout appears to be essential to a suitable plastic bottle design, stackability of current plastic bottle simply is not possible.

When plastic bottles are used for motor oil, the ability to stack and display the motor oil containers in the traditional manner, is not possible. The extended, central spout and the tapering sides of the spout and neck portion preclude the ability to stack these containers and as a result, what is typically done is to stack them in their shipping boxes or crates and simply not make them visible or attractively displayed as was once done for the predecessor style of container for motor oil.

The present invention by its unique shape and contour offers a solution to the aforementioned shortcomings of prior art plastic bottles while still offering all of the cost and usage benefits of such plastic bottles. Whether the bottles are used for motor oil or other products, the benefits of the present invention are equally applicable. The present invention provides a stackable plastic bottle which includes a pair of oppositely disposed recesses between the spout outlet and the body portion of the bottle. These recesses provide a substantially horizontal plateau or shelf portion and an inward peripheral wall. This plateau or shelf portion is designed and arranged such that it is able to receive a portion of the base of the bottles which are stacked thereon and the pyramiding of such bottles, layer after layer, is easily accomplished.

SUMMARY OF THE INVENTION

A stackable bottle for enabling a pyramidal display of several such bottles according to one embodiment of the present invention comprises a main body portion having a base and surrounding side walls which define a contents-receiving cavity, a neck portion which is integral with and extending upwardly from the main body portion and terminating in an outlet opening through which the contents of the stackable bottle are dispensed, and a pair of recesses disposed in the neck portion with each recess being defined by a shelf and peripheral wall, the shelf and peripheral wall being designed and arranged to receive, in part, the base of a corresponding stackable bottle.

One object of the present invention is to provide an improved stackable bottle.

Related objects and advantages of the present invention will be apparent from the following description.

DESCRIPTION OF THE PREFERRED EMBODIMENT

Figure 2:
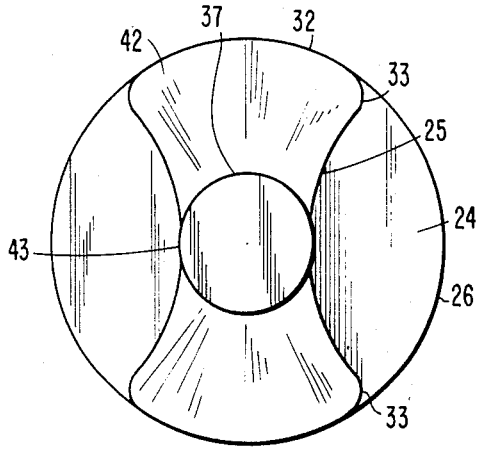
FIG. 2 is a side elevation view of the FIG. 1 stackable plastic bottle.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
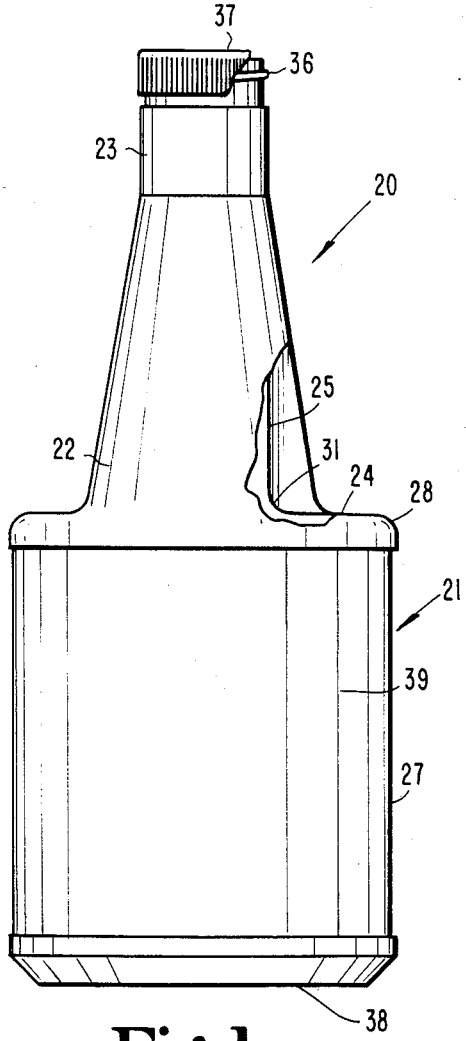
FIG. 1 is a fragmentary, front elevation view of a stackable plastic bottle according to a typical embodiment of the present invention.
Figure 3:
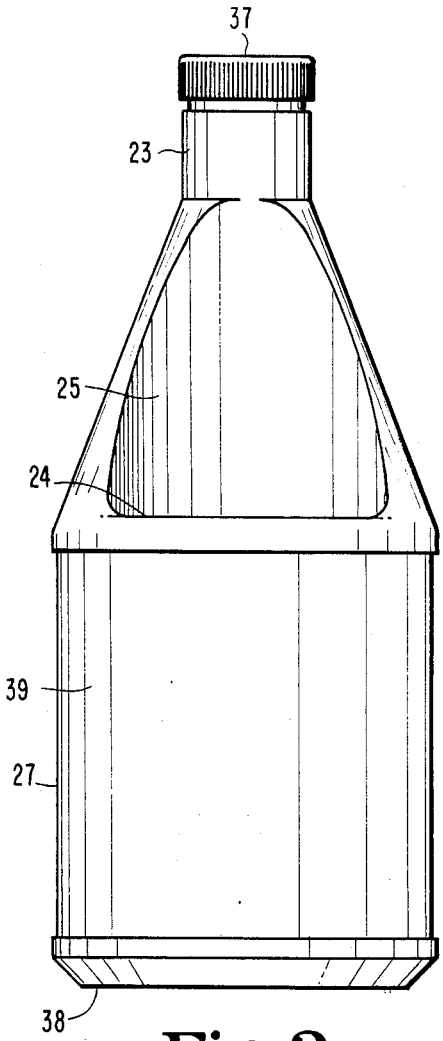
FIG. 3 is a top plan view of the FIG. 1 stackable plastic stackable bottle.

Referring to FIGS. 1–3, a stackable plastic bottle 20 according to the teachings of the present invention is illustrated. Bottle 20 includes a main body portion 21, a neck portion 22, and a spout 23. As should be understood from a review of FIGS. 1, 2 and 3, the neck portion has a very unique shape. In one orientation, it appears to be conical, although truncated at its apex in order to provide for the spout, yet as is clearly indicated by the FIG. 2 illustration, this conical shape does not extend for the full 360 degrees. Instead, opposite sides of the neck portion have been configured with recessed areas defined by a plateau or shelf 24 and peripheral wall 25.

The conical profile of neck portion 22 as seen in FIG. 3 is more precisely described as a frustum or a frustum of a cone due to the existence of spout 23. As is illustrated, the outer edge 26 is effectively the same as the outer surface 27 of body portion 21, but is not technically coincident due to the presence of radiused surface 28 which provides the connection between outer surface 27 and shelf 24.

Figure 4A:
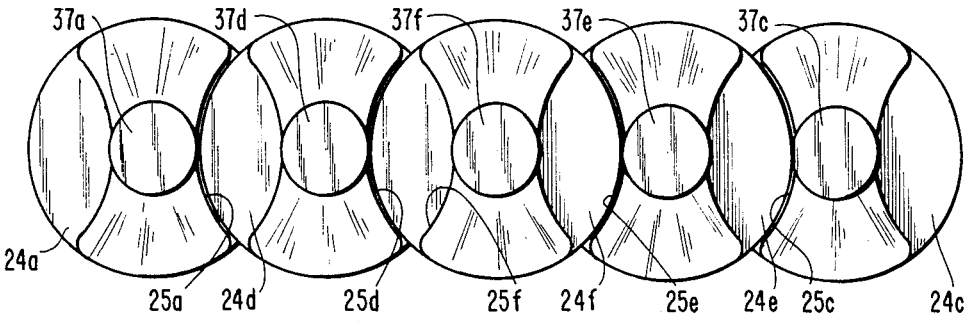
FIG. 4A is a top plan view of the FIG. 4 pyramidal stack.
Figure 4:
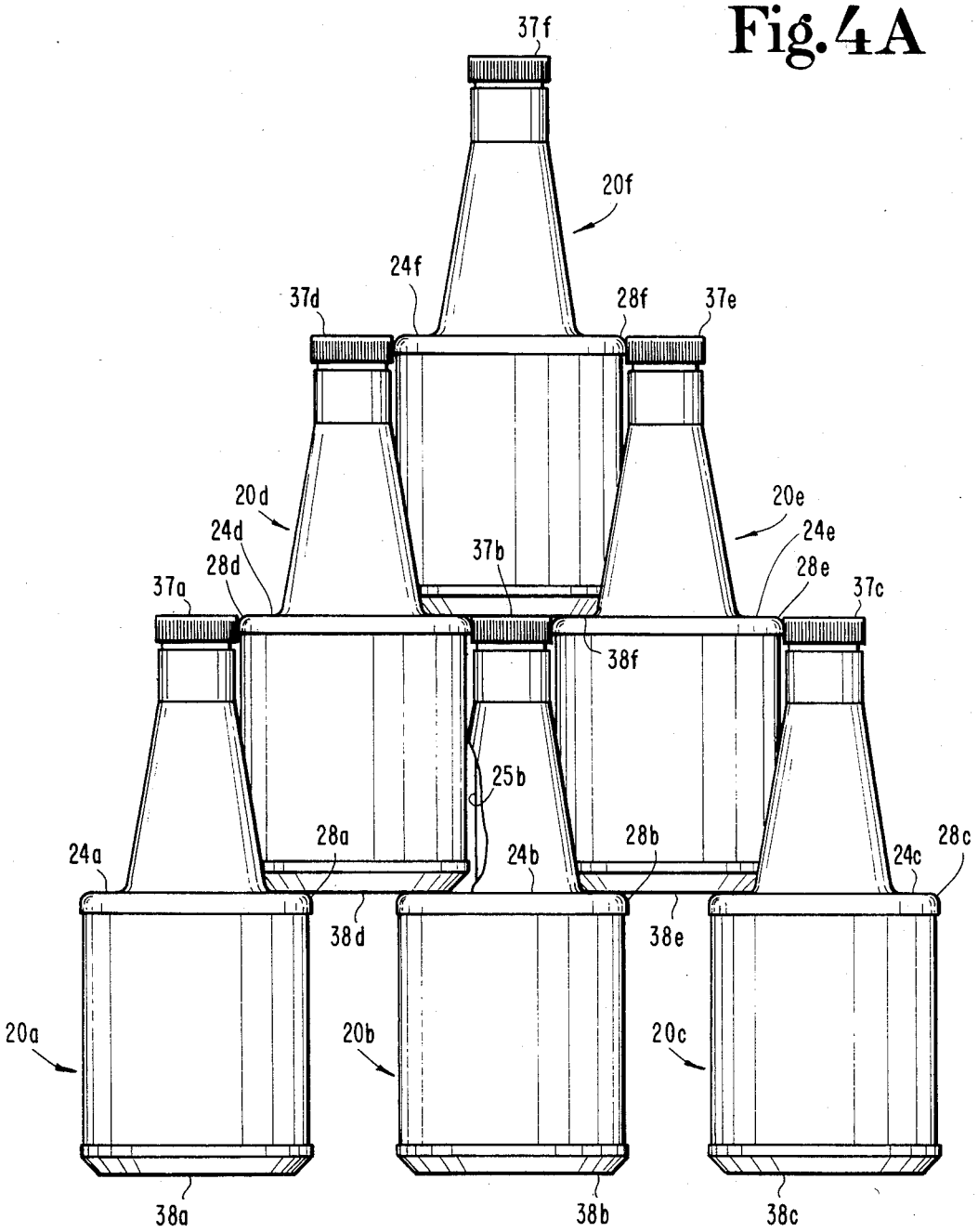
FIG. 4 is a front elevation view of a pyramidal stack of six stackable plastic bottles according to the FIG. 1 design.

Peripheral wall 25 extends upwardly from shelf 24 utilizing a radiused inside corner 31 as the portion of transition between the shelf and the peripheral wall. Additionally, peripheral wall 25 has a concave curvature which follows the inner peripheral portion of shelf 24 and blends into the outer surface 32 of the neck portion by means of radiused edges 33. The curvature of peripheral wall 25 as is illustrated in FIG. 2 is specifically selected and arranged so as to generally match the curvature of outer surface 27. This matching curvature contributes to the stability of the pyramidal stacking which is enabled by the recesses which are defined by the shelf and peripheral wall. This stacking concept is illustrated in FIGS. 4 and 4A which will be described in greater detail hereinafter.

Spout portion 23 which is generally cylindrical extends upwardly from the neck portion in a substantially concentric manner and terminates with an externally threaded outlet 36 which is sealed and which may be resealed by means of internally threaded closure 37. In the exemplary embodiment, closure 37 is a traditional plastic screw-on, screw-off cap with internal threads which match the threads of the externally threaded outlet 36. However, the present invention is compatible with any of a variety of specially styled closures such that if the contents within plastic bottle 20 dictate, the closure and in fact the outlet 36 may be styled so as to be tamper-evident, child-resistant or with one of many warning type mechanisms to insure the integrity and nontampering with the contents.

It is also to be understood and will be illustrated hereinafter that the general shape, contour, diameter and height of the neck portion and spout portions may be varied significantly while still retaining the essence of the present invention which are the recesses defined by the shelf and peripheral wall such that corresponding plastic bottles may be stacked in a pyramidal configuration.

Figure 5:
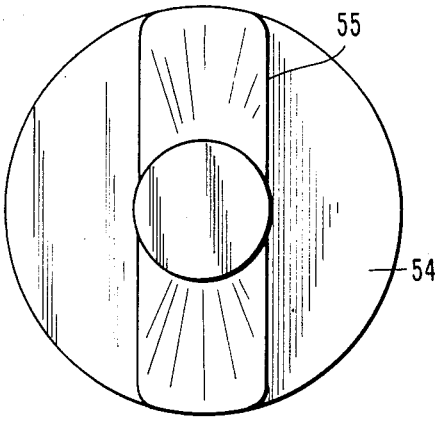
FIG. 5 is a top plan view of a stackable plastic bottle according to a typical embodiment of the present invention.

Body portion 21 includes a base 38 and surrounding wall 39. The height, diameter and shape of body portion has been selected so as to represent an approximate one liter or one-quart volume, typical of automobile motor oil. The only relationship which the base portion has to the remaining portions of the plastic bottle pertain to placement of the base 38 of one bottle onto the shelf 24 of a corresponding bottle. Additionally, it is important that the neck portion be contoured so as to not only provide the appropriate recess, but to provide an upwardly extending peripheral wall for the recess which does not interfere with the outer surface 27 of the surrounding wall 39 of the body portion. Although in the FIGS. 1–3 illustrations, peripheral wall 25 has been illustrated as having a concave curvature, an alternative configuration is illustrated in FIG. 5. Although the peripheral wall in FIG. 5 is not curved, it is of a certain style and shape which does not interfere with outer surface 27, and thus is also a suitable alternative in accordance with the teachings of the present invention. Although the curved peripheral wall 25 is believed to be preferred, from the standpoint of the integrity and stability of a pyramidal stack, the alternative embodiment of FIG. 5 may represent a simpler mold design and a lower-cost bottle due to the mold cost and the use of less material to create the bottle.

Referring to FIGS. 4 and 4A, a six-bottle, pyramidal stack is illustrated. It is to be understood from these illustrations that each of the stackable plastic bottles 20 are virtually identical to each other, all being fabricated by the same molding die and operation. Any variance between individual bottles of this plurality of bottles would only be that variance normally attributable to minor tolerance variations due to the molding process. As is illustrated, the lower row of bottles are spaced apart from one another a distance which is just sufficient to enable clearance for the body portion of the second row bottles to be placed onto the corresponding shelves 24 and fit within the corresponding perpheral walls 25. Although many of the reference numerals have been added based upon the FIG. 1 illustrations, each of these numerals have been subscripted with the letters "a," "b," "c," "e," "d," and "f" so as to differentiate between the six bottles used to illustrate the pyramidal stacking capability enabled by the present invention. This subscripting by lower case letters is not intended to suggest that the bottles are in fact different. As previously explained, they should be substantially identical to one another.

As is believed well illustrated by FIG. 4, the concave curvature to peripheral wall 25 enables the stacked-on bottle to be effectively locked into position such that it cannot easily shift to the front or the rear (see FIG. 4A), a capability which would not be provided to the same degree by the alternative configuration of FIG. 5.

Continuing to refer to FIGS. 4 and 4A, other size and shape relationships are exhibited. For example, by placing the receiving bottles sufficiently close to one another so that the outer surface of the received base is almost in contact with the corresponding pair of recess-defining peripheral walls, the clearance space left between the body portions of the receiving bottles is virtually identical to the diameter of the spout which also happens to coincide with the width or thickness of the neck portion at its thinnest point (see FIG. 2). In cooperation with this relationship is the fact that the height of the plastic bottle from the top surface of the shelf to the top surface of the screw-on cap is virtually the same as the dimension from the shelf to the base 38. As a result, and as is illustrated in FIG. 4, the pyramidal stacking of plastic bottles 20 creates an almost solid wall with few if any space gaps visible, with the exception of the lowest or first row. The result is a very neatly stacked, very stable, compact configuration.

A further benefit derived from these dimensional and size relationships is the ability to invert one bottle onto and between two other bottles so that the downwardly extending spout of the received bottle fits between the corresponding body portions of the receiving two bottles. The result is the aforementioned solid wall and this unique, invertible, stackable capability enables 20 quart bottles to be shipped within the approximate same sized cardboard carton that previously would only accommodate 12 nonstackable one-quart bottles.

A further benefit of the present invention which has been recognized is that the recessed areas defined by shelf 24 and peripheral wall 25 result in a contoured and reduced width for the neck portion 22. Reference to the FIG. 2 illustration is preferred in order to visualize the unusual contour for neck portion 22. What is actually created by the pair of oppositely disposed recesses is a grasping rib 42 whose outside surface 32 represents its widest point with its narrowest point being at location 43 at which point the thickness or width of the neck portion is substantially the same as the diameter of spout portion 23. In grasping stackable plastic bottle 20 by the neck, the wider outer portion fits snugly within the palm of the user's hand thereafter allowing the thumb and fingers to extend inwardly and close onto the narrower portion at or near location 43. The result is a very secure and easily grasped plastic bottle which is not likely to fall or slip from the user's grasp even if the user's hand is wet or slippery. Further, as the stackable plastic bottle 20 is turned in order to pour or empty the contents, the center of gravity passes through or near to the point at which the neck is grasped, further contributing to the ease with which plastic bottle 20 may be utilized.

Figure 6:
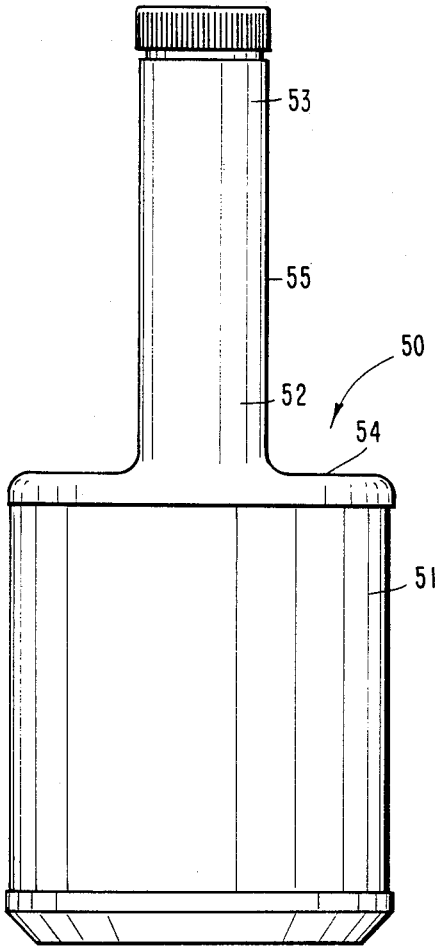
FIG. 6 is a front elevation view of the FIG. 5 stackable plastic bottle.
Figure 7:
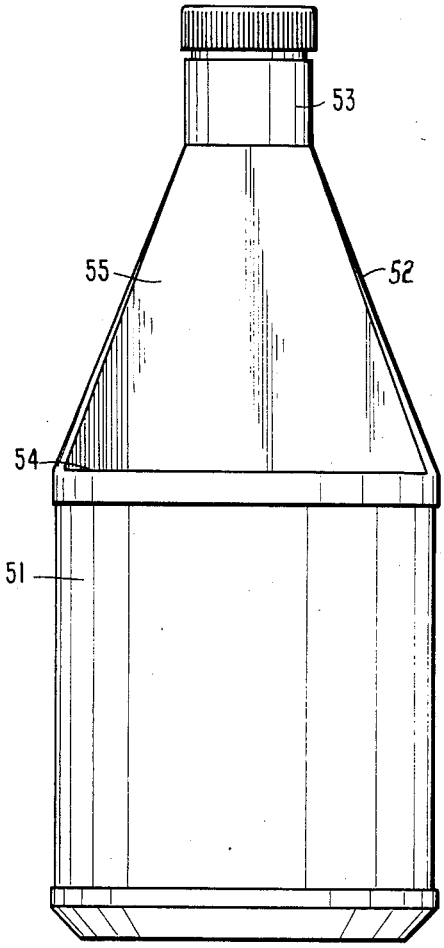
FIG. 7 is a side elevation view of the FIG. 5 stackable plastic bottle.

Referring to FIGS. 5–7, an alternative plastic bottle style is illustrated. Although still stackable, and although including most of the benefits of stackable plastic bottle 20, bottle 50 represents what may be a less-expensive design and a less costly bottle due to a slight reduction in plastic material.

Stackable plastic bottle 50 includes a body portion 51, a neck portion 52, and a spout 53 which is centrally disposed relative to the neck portion and upwardly extending from the neck portion. In FIG. 7 the profile of neck portion 52 may be more precisely described as trapezoidal. All of the size and shape characteristics described for bottle 20 and all the dimensional relationships existing for bottle 20 exist in bottle 50 with one exception. The only difference between bottle 50 and bottle 20 is that shelf 54 has a substantially straight inside periphery and peripheral wall 55 is substantially straight (flat) in lieu of being concave as was the case with peripheral wall 25. The top plan view of FIG. 5 best illustrates the revised relationship between the shelf and the peripheral wall which still define the receiving recess for the body portion of the stacked-on bottle. What is not provided by the FIG. 5 style is the wrap-around configuration for the peripheral wall which contributes to locking and holding in the received bottles. Although a stacked and pyramidal arrangement of bottles 50 do not have a tendency to fall or topple over due to the weight of the contents in each bottle, some difference in the stability of the pyramidal stack relative to a stack of bottles 20 is anticipated.

Figure 10:
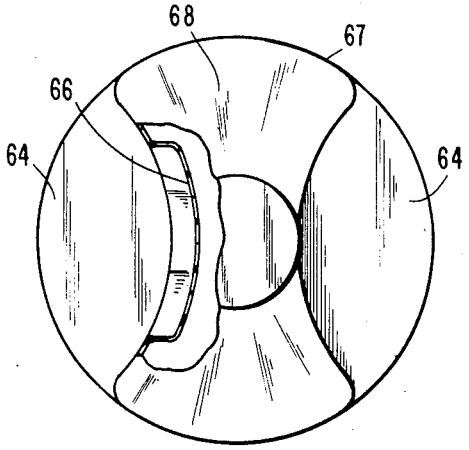
FIG. 10 is a top plan view of the FIG. 8 stackable plastic bottle.
Figure 8:
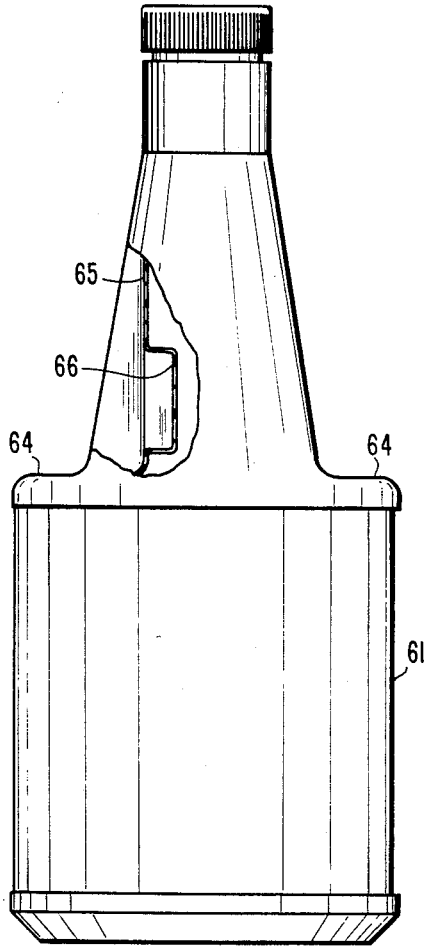
FIG. 8 is a front elevation view of a stackable plastic bottle according to a typical embodiment of the present invention.
Figure 9:
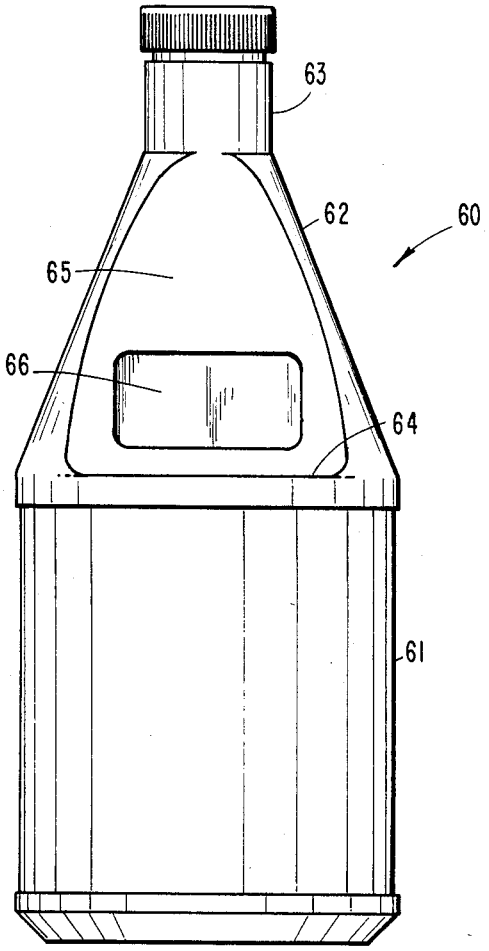
FIG. 9 is a side elevation view of the FIG. 8 stackable plastic bottle.

Referring to FIGS. 8, 9 and 10, a stackable plastic bottle design very similar to that illustrated in FIG. 1 is disclosed. Stackable plastic bottle 60 includes a body portion 61, neck portion 62 and spout 63. Shelf 64 has an outer convex curved edge which substantially matches the curvature of the outside surface of the body portion and a concave inside peripheral edge which matches the shape of the upwardly extending peripheral wall 65. So far, the size, shape and configuration of bottle 60 is identical to bottle 20. The only difference between the two designs is that bottle 60 includes an oppositely disposed pair of generally rectangular depressions 66 located in each upwardly extending peripheral wall. Although illustrated as positioned in the lower, central area of wall 65, these depressions can be disposed in virtually any area of the peripheral wall depending on the particular size and shape of the bottle. The purpose of depressions 66 is to provide a grasping location for the fingers and thumb of the user's hand. Although previously, the grasping rib 42 for bottle 20 was described as providing this capability, the size and configuration of bottle 20 is intended to represent a one-liter or one-quart volume capacity, as would be typical of motor oil. In this configuration, the neck diameter and thickness are such as to be easily grasped by a user's hand and the weight represented by one quart of motor oil is sufficiently light that the bottle can be easily manipulated with one hand. However, the stackable plastic bottle concept of the present invention is not limited to one-quart bottles of automobile motor oil. The stackable concept is applicable to a tremendous number of plastic bottles for a wide range of products. Consequently, it is envisioned that half-gallon and gallon bottles may be fabricated according to the teachings of the present invention. Under those circumstances, the neck portion may be larger, it may have a greater diameter and thickness such that the bottle might not be held quite as easily. Further, a half-gallon or gallon size could represent a substantial increase in weight, depending on the contents, and by molding depressions 66 into periperal wall 65, a built-in handle is provided for these larger bottles. In accordance with the manner of grasping as previously described, it is envisioned that the wider outer curved surface 67 will be placed into the palm of the hand of the user with the thumb being placed on one side of grasping rib 68 and placed in one depression 66 while some or all of the fingers are then placed into the opposite depression 66 in order to complete the grasping maneuver.

Figure 11:
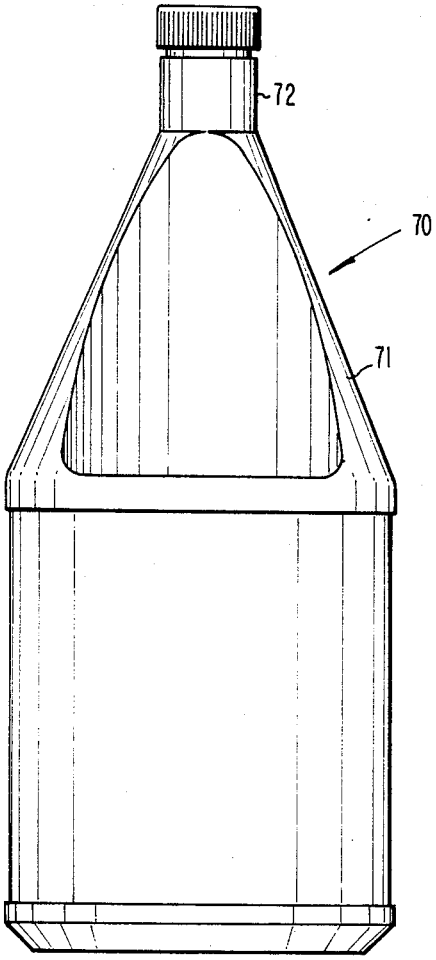
FIG. 11 is a front elevation view of a stackable plastic bottle according to a typical embodiment of the present invention.
Figure 12:
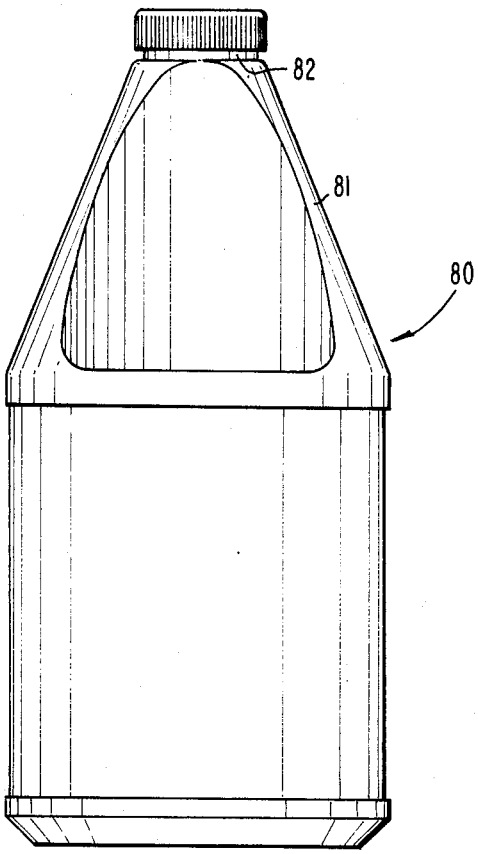
FIG. 12 is a front elevation view of a stackable plastic bottle according to a typical embodiment of the present invention.

Referring to FIG. 11, a slightly revised stackable plastic bottle 70 according to the present invention is illustrated. It is to be understood that this bottle is designed with all of the teachings and characteristics as previously described for plastic bottles 20, 50 and 60, excepting those variances between the three styles. The purpose of the FIG. 11 illustration is to indicate that the neck 71 and spout 72 may involve a variety of tapers, diameters and heights. Similarly, the FIG. 12 illustration represents yet one further stackable plastic bottle variation. Bottle 80 includes a neck 81 and spout 82 whose shape variations are still compatible with the teachings of the present invention. Virtually any neck and spout are suitable for the stackable plastic bottle disclosed herein, wherein oppositely disposed recesses are provided as part of the neck portion so as to receive a compatibly styled plastic bottle for the purposes of pyramidal stacking.

A few other relationships with regard to the plastic bottle designs disclosed herein should be made simply to round out a thorough understanding of the present invention. As should be understood, the various recesses which are defined by the shelf and peripheral wall are arranged in pairs which are oppositely disposed on each plastic bottle. These recesses are effectively 180° apart and while that is believed to be the preferred arrangement, it should be understood that the spacing of the two recess could be varied and additional recesses could be added. For example, if the recesses are located 120 degrees apart, then the pyramidal stacking concept could be achieved in a multiple thickness of plastic bottles as opposed to a single thickness of stacked bottles. Although this is not considered to be the preferred arrangement, it simply illustrates one further variation of the present invention.

Additionally, the peripheral walls longitudinally extend in a direction which is substantially perpendicular to their corresponding shelves and those shelves are substantially parallel to the base of each body portion. Each body portion is substantially cylindrical and each spout is substantially cylindrical and symmetrically and centrally arranged to its corresponding neck portion and body portion. Similarly, the neck portion is symmetrical to the body portion and the entire bottle is fabricated as a unitary molded member out of a suitble plastic, the concept of "suitable" being dependent on the contents.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A stackable bottle for enabling a pyramidal display of several bottles comprises:

a main body portion including a base and surrounding cylindrical side wall which cooperatively define a contents-receiving cavity;

a frustum profiled neck portion which is integral with and extends upwardly from said main body portion and terminates in an outlet opening through which the contents of said stackable bottle pass; and a plurality of receiving recesses disposed in said neck portion, each said recess having a shape generally defined by the geometric intersection of a vertical frustum with a vertical cylinder and with a horizontal plane, said vertical frustum and said vertical cylinder being nonconcentric, and each said recess being defined by a shelf and cooperating part cylindrical peripheral wall, said shelf and peripheral wall being designed and arranged to receive, in part, the main body portion of a second and corresponding stackable bottle.

2. The stackable bottle of claim 1 wherein said neck portion includes a spout, said spout including said outlet opening.

3. The stackable bottle of claim 2 wherein said receiving recesses are oppositely disposed to one another approximately 180° apart.

4. The stackable bottle of claim 1 wherein said shelf is substantially parallel to said base and said peripheral wall is substantially perpendicular to said shelf.

5. The stackable bottle of claim 1 wherein said bottle is molded as a unitary plastic member and wherein said receiving recesses are oppositely disposed.

6. The stackable bottle of claim 1 wherein said shelf has an outer convex edge and an inner concave edge and said peripheral wall is curved to match said inner concave edge.

7. The stackable bottle of claim 6 wherein said receiving recesses are oppositely disposed.

8. The stackable bottle of claim 1 wherein said shelf includes an outer convex edge and an inner curved edge and where said peripheral wall matches said inner substantially straight edge.

9. The stackable bottle of claim 8 wherein said receiving recesses are oppositely disposed.

10. The bottle of claim 9 wherein said shelf is substantially parallel to said base and said peripheral wall is substantially perpendicular to said shelf.

11. The stackable bottle of claim 10 wherein said bottle is fabricated as a molded, unitary member of plastic.

12. The stackable bottle of claim 11 wherein said neck portion includes a spout and said spout includes said outlet opening.

13. A stackable bottle for enabling a pyramidal display of several bottles comprises:

a main body portion including a base and surrounding side wall which cooperatively define a contents-receiving cavity;

a neck portion which is integral with and extends upwardly from said main body portion and terminates in an outlet opening through which the contents of said stackable bottle pass; and a pair of receiving recesses disposed in said neck portion, each recess being defined by a shelf and cooperating peripheral wall, said shelf and peripheral wall being designed and arranged to receive, in part, the main body portion of a second and corresponding stackable bottle, wherein said neck portion extends between said shelf and said outlet opening and has an overall height substantially equal to the overall height of said main body portion which extends from its base to said shelf.

14. A stackable bottle for enabling a pyramidal display of several bottles comprises:

a main body portion including a base and surrounding side wall which cooperatively define a contents-receiving cavity;

a neck portion which is integral with and extends upwardly from said main body portion and terminates in an outlet opening through which the contents of said stackable bottle pass;

a pair of receiving recesses disposed in said neck portion, each recess being defined by a shelf and cooperating peripheral wall, said shelf and peripheral wall being designed and arranged to receive, in part, the main body portion of a second and corresponding stackable bottle; and a pair of finger-grip depressions, there being one each disposed in each peripheral wall.

15. The stackable bottle of claim 14 wherein said receiving recesses are oppositely disposed and define an oppositely disposed pair of grasping ribs.

16. The stackable bottle of claim 15 wherein said finger-grip depressions are located inwardly from the outer edge of one grasping rib and said depressions are designed and arranged to receive portions of a user's hand.

17. The stackable bottle of claim 14 wherein said neck portion includes a spout and said spout includes said outlet opening.

18. The stackable bottle of claim 14 wherein said shelf is substantially parallel to said base and said peripheral wall is substantially perpendicular to said shelf.

19. The stackable bottle of claim 14 wherein said neck portion extending between said shelf and said outlet opening is substantially the same height as said main body portion extended between said base and said shelf.

20. A stackable bottle for enabling a pyramidal display of several bottles comprises:

a main body portion including a base and surrounding cylindrical side wall which cooperatively define a contents-receiving cavity;

a neck portion which in one orientation has a trapezoidal profile, said neck portion being integral with and upwardly extending from said main body portion and terminates in an outlet opening through which the contents of said stackable bottle pass; and two receiving recesses disposed in said neck portion, each of two said recesses having a shape generally defined by the geometric intersection of a vertical frustum with a vertical plane and with a horizontal plane, each of two said recesses being defined by a shelf and cooperating planar peripheral wall, each of said planar peripheral walls being substantially parallel to one another, each of said shelves being defined by an inner edge and an outer edge, each of said outer edges being curved with a shelf curvature comprising an arc of a circle and each of said inner edges being substantially linear and having a length defined by the chord of said arc of a circle, each of two said recesses being designed and arranged to receive, in part, the main body portion of a second and corresponding stackable bottle.

* * * * *